US010889015B2

(12) United States Patent
Gandon

(10) Patent No.: US 10,889,015 B2
(45) Date of Patent: Jan. 12, 2021

(54) HAIR CUTTING SCISSORS

(71) Applicant: NOVACOIFF, Saint Sebastien sur Loire (FR)

(72) Inventor: Julien Gandon, Monterblanc (FR)

(73) Assignee: NOVACOIFF, Saint Sebastien sur Loire (FR)

( * ) Notice: Subject to any disclaimer, the term of this patent is extended or adjusted under 35 U.S.C. 154(b) by 69 days.

(21) Appl. No.: 15/564,126

(22) PCT Filed: Apr. 4, 2016

(86) PCT No.: PCT/FR2016/050762

§ 371 (c)(1),
(2) Date: Oct. 3, 2017

(87) PCT Pub. No.: WO2016/162621

PCT Pub. Date: Oct. 13, 2016

(65) Prior Publication Data

US 2018/0079091 A1 Mar. 22, 2018

(30) Foreign Application Priority Data

Apr. 7, 2015 (FR) ..... 15 52948

(51) Int. Cl.
*B26B 13/20* (2006.01)
*B26B 13/14* (2006.01)
(Continued)

(52) U.S. Cl.
CPC ..... *B26B 13/20* (2013.01); *B25G 1/102* (2013.01); *B26B 13/12* (2013.01); *B26B 13/14* (2013.01)

(58) Field of Classification Search
CPC ..... B23B 13/12; B23B 13/20; B23B 13/14; B66F 7/0691; B26B 13/12; B26B 13/20; B26B 13/14; B25G 1/102
See application file for complete search history.

(56) References Cited

U.S. PATENT DOCUMENTS 440,436 A * 11/1890 Pearsall ..... B26B 13/20 30/341
2,939,213 A * 6/1960 Daniel ..... B26B 13/04 30/260

(Continued)

FOREIGN PATENT DOCUMENTS

FR 2955284 7/2011
TW M366459 10/2009

OTHER PUBLICATIONS

International Search Report dated Feb. 1, 2016.

*Primary Examiner* — Andrea L Wellington
*Assistant Examiner* — Fernando A Ayala
(74) *Attorney, Agent, or Firm* — Ipsilon USA, LLP

(57) ABSTRACT

A pair of scissors has two shears movably mounted to pivot about an axis, each of the shears having a blade (3) extended by a shank (4, 5). The first shank (4) is covered by a grip in the form of an elongate body that is provided with a lateral opening (8) and that is suitable for being inserted transversely between two fingers of a hand to a position where it bears against the crook where the two fingers meet. The second shank (5) is terminated by a half-ring forming a cradle (10) for receiving the thumb. The first shank (4) is a bent shank. The lateral opening (8) in the elastically deformable grip extends into the inside of the grip forming a sheath into which the first shank (4) can be inserted in adjustable manner by slidable movement. The end of the cradle (10) that is closer to the first shank (4) is bent towards the inside of the cradle to form an abutment (11) for retaining the thumb.

9 Claims, 6 Drawing Sheets

(51) Int. Cl.
*B25G 1/10* (2006.01)
*B26B 13/12* (2006.01)

(56) References Cited

U.S. PATENT DOCUMENTS

| | | | | | |
|---|---|---|---|---|---|
| 3,861,038 | A | | 1/1975 | Aucun | |
| D239,497 | S | * | 4/1976 | Megna | B26B 13/04 D8/57 |
| D258,930 | S | * | 4/1981 | Wahlberg | D8/22 |
| 5,046,381 | A | * | 9/1991 | Mueller | B26B 13/20 294/25 |
| 5,463,814 | A | | 7/1995 | Stowell | |
| 5,781,999 | A | * | 7/1998 | Chang | B26B 13/20 30/232 |
| 5,819,416 | A | * | 10/1998 | Robinson | B26B 13/20 30/257 |
| 6,883,238 | B1 | * | 4/2005 | Tran | B26B 13/20 30/232 |
| 2002/0077649 | A1 | * | 6/2002 | Lasner | A61B 17/2841 606/174 |
| 2002/0112352 | A1 | | 8/2002 | Droin | |
| 2006/0009795 | A1 | * | 1/2006 | Lasner | A61B 17/30 606/174 |
| 2006/0064879 | A1 | * | 3/2006 | Lauritzen | B26B 13/20 30/232 |
| 2013/0097875 | A1 | * | 4/2013 | Lin | B26B 13/00 30/194 |

* cited by examiner

HAIR CUTTING SCISSORS

RELATED APPLICATION

This application is a National Phase of PCT/FR2016/050762, filed on Apr. 4, 2016 which in turn claims the benefit of priority from French Patent Application No. 15 52948, filed on Apr. 7, 2015, the entirety of which are incorporated by reference.

BACKGROUND

Field of the Invention

The invention relates to a pair of scissors, in particular for cutting hair.

More particularly, the invention relates to a pair of scissors comprising two shears movably mounted to pivot about an axis between a closed position and an open position of the pair of scissors, each of said shears comprising a blade extended by a shank, said blades extending in a closed position of the pair of scissors along an axis of the pair of scissors, referred to as the "longitudinal" axis, one of the shanks, referred to as the "first" shank, being arranged at least in part in a plane co-operating with the plane containing the longitudinal axis of the pair of scissors and the pivot axis to form an angle A lying in the range 35° to 60° and being spaced apart, over at least a fraction of its length from its connection zone with the blade towards its free end, from the plane in which the blades move by an angle B of at least 35°, the first shank being coverable at least in part by a grip in the form of an elongate body suitable for being inserted transversely between two fingers, generally the ring finger and the middle finger, of a hand to a position in which it bears against the crook where said fingers meet, the grip having a lateral opening and, at the end of the body adjacent to said opening, a bearing zone for a distal phalange of at least one of the fingers between which the grip is suitable for being inserted, the other shank, referred to as the "second" shank, being terminated by a half-ring forming a cradle for receiving the thumb.

Description of Related Art

Such a pair of scissors is disclosed in particular in patent FR 2 955 284. That pair of scissors is designed in such a manner as to enable the hand to remain in line with the wrist, thereby limiting hand/wrist movements during cutting operations, and thus reducing the risks of musculoskeletal disorders.

That pair of scissors also enables the operator to limit resorting to postures that are uncomfortable and that might potentially lead to injury.

OBJECTS AND SUMMARY

An object of the invention is to propose an improvement to the above-mentioned pair of scissors in order to make it easier to adapt said pair of scissors to a wide variety of hands, without degrading the other qualities of said pair of scissors.

To this end, the invention provides a pair of scissors, in particular for cutting hair, the pair of scissors comprising two shears mounted to move in pivoting about an axis, each of said shears comprising a blade extended by a shank, said blades extending in a closed position of the pair of scissors along an axis of the pair of scissors, referred to as the "longitudinal" axis, one of the shanks, referred to as the "first" shank, being arranged at least in part in a plane co-operating with the plane containing the longitudinal axis of the pair of scissors and the pivot axis to form an angle A lying in the range 35° to 60° and being spaced apart, over at least a fraction of its length from its connection zone with the blade towards its free end, from the plane in which the blades move by an angle B of at least 35°, the first shank being suitable for being covered at least in part by a grip in the form of an elongate body suitable for being inserted transversely between two fingers, generally the ring finger and the middle finger, of a hand to a position in which it bears against the crook where said fingers meet, the grip having a lateral opening and, at the end of the body adjacent to said opening, a bearing zone for a distal phalange of at least one of the fingers between which the grip is suitable for being inserted, the other shank, referred to as the "second" shank, being terminated by a half-ring forming a cradle for receiving the thumb, the pair of scissors being characterized in that the first shank, of rectangular or square cross-section, is a bent shank with the portion referred to as the "second" portion of the first shank that lies between the free end and the bend of said shank co-operating with the portion referred to as the "first" portion of the first shank lying between the bend and the zone where the first shank joins the blade to form an angle lying in the range 80° to 120°, in that the elastically deformable grip having its lateral opening extended into the inside of the grip forms a sheath into which at least the second portion of the first shank can be inserted in position-adjustable manner by moving in sliding, and in that the end of the cradle closer to the first shank has a bend towards the inside of the cradle so as to form an abutment for retaining the thumb.

Making the first shank in the form of a bent shank, and mounting the grip slidably on said first shank makes it possible, by co-operation between the grip and the first shank, to vary the relative position of the finger-bearing zone provided by the grip so as to make it possible to accommodate fingers that are broader or longer or to accommodate two fingers such as the middle finger and the index finger, instead of only one finger, in order to adapt to certain cutting techniques.

In parallel, the presence of an abutment for retaining the thumb on the second shank enables force to be transmitted better between the hand and the pair of scissors, while reducing any risk of the thumb slipping out of the cradle.

Preferably, the first portion of the first shank presents a length of not less than 1.5 centimeters (cm).

In an embodiment, the retaining abutment is made in the form of a fitting fitted to said cradle.

In a variant, the cradle and the retaining abutment are made as a single piece.

Preferably, said cradle, arranged in a plane parallel to the plane in which the blades move, defines a portion of a circle of center O, and the straight line passing through the center of the circle and the point of intersection between the pivot and longitudinal axes of the blades co-operate with the longitudinal axis of the pair of scissors to form an angle of not less than 20°.

Preferably, the distance between the center of the circle portion defined by the cradle and the point of intersection between the pivot and longitudinal axes of the blades is not less than 3.5 cm.

Preferably, the second portion of the first shank is curved with the concave side of the curve facing towards the movement plane of the blades.

Preferably, the grip and the first shank include respective markings for identifying how to insert the first shank into the inside of the grip. This marking makes it easier to move the first shank in sliding inside the grip.

Preferably, the grip is made of rubber or of elastomer, preferably selected from the group formed by a silicone rubber, a nitrile rubber, an ethylene-propylene-diene monomer (EPDM), or by a polyurethane, having hardness lying in the range 60 to 80 on the Shore A scale.

BRIEF DESCRIPTION OF THE DRAWINGS

The invention can be well understood on reading the following description of embodiments, given with reference to the accompanying drawings, in which.

DETAILED DESCRIPTION

Figure 1:
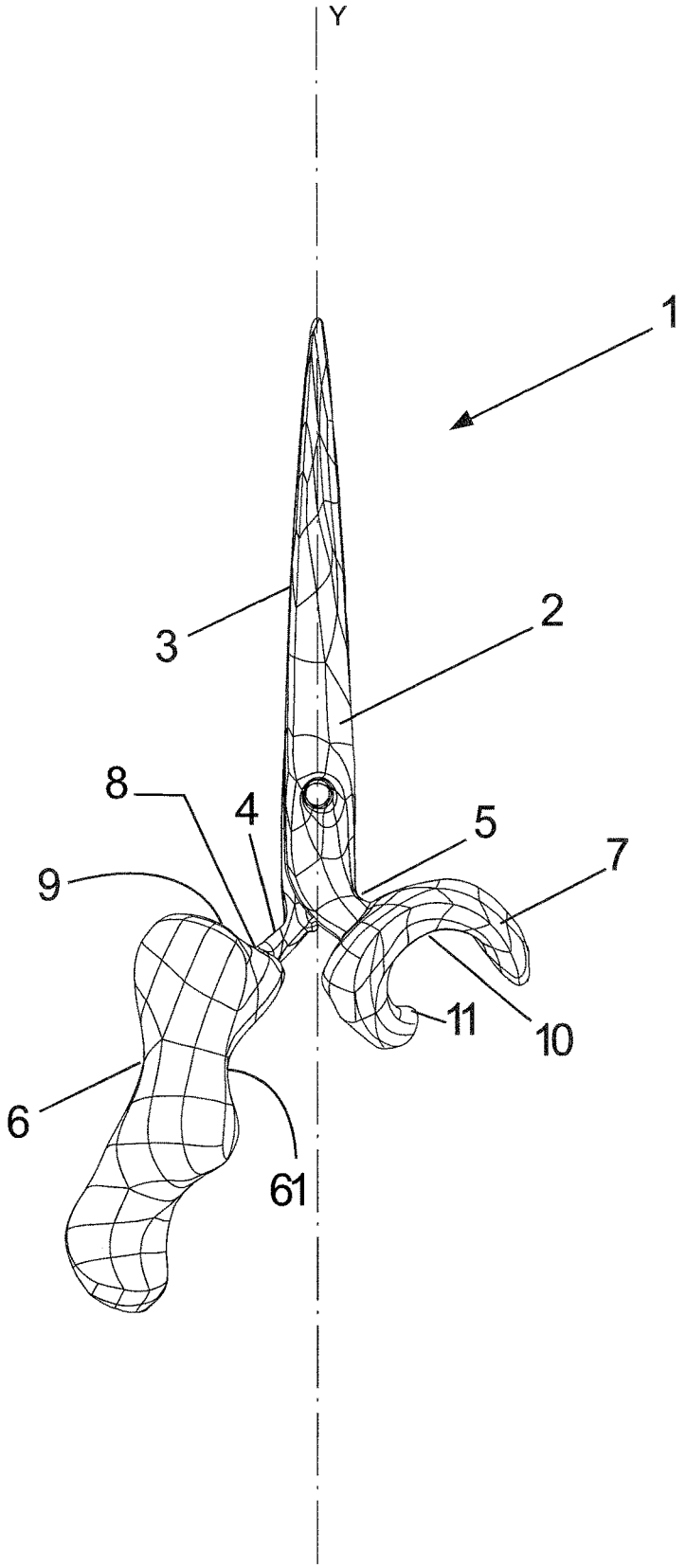
FIG. 1 is a perspective view in elevation of a pair of scissors in accordance with the invention.
Figure 2:
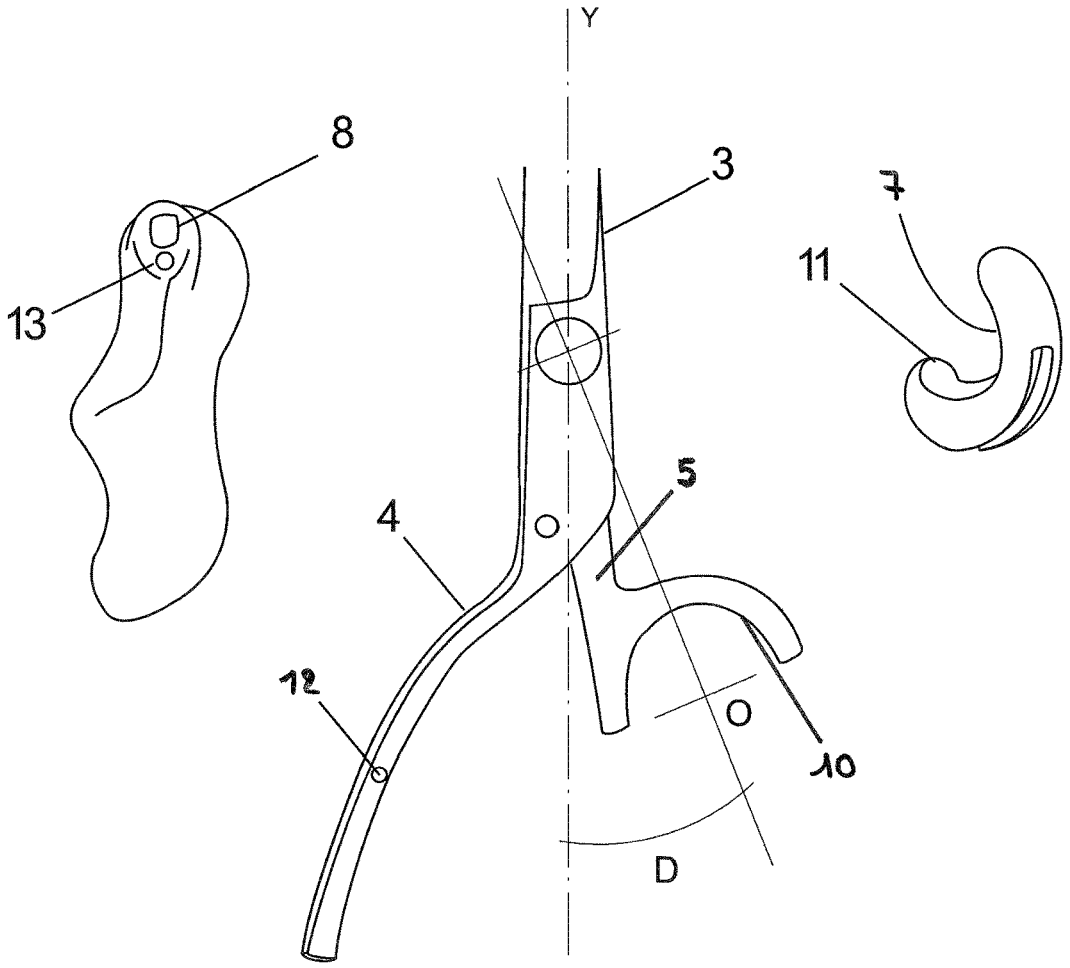
FIG. 2 is a fragmentary view of a pair of scissors with the grip and the fitting equipped with the retaining abutment shown in the non-mounted state.

As mentioned above, the invention provides a pair 1 of scissors, more particularly for cutting hair. This pair 1 of scissors comprises two shears 2. Each shear 2 comprises a cutting blade 3 extended by a shank. One of the shanks, referred to as the "first" shank is referenced 4 in the figures, while the other shank, referred to as the "second" shank, is referenced 5 in the figures.

The shears 2 are assembled together via a movable pivot connection that pivots about an axis X to allow said shears blades to go from a close-together position in which they overlap partially in a closed position of the pair of scissors to a position where they are spaced apart from each other in an open position of the pair of scissors.

In the closed position of the pair of scissors, these blades 3 extend along an axis referred to as the "longitudinal" axis Y of the pair of scissors and they move in a plane referred to as the "blade movement" plane P2 in order to pass from the closed position to the open position, and vice versa.

In the closed position of the pair of scissors, the shank 4 is arranged at least in part in a plane P that co-operates with the plane P1 containing both the longitudinal axis Y of the pair 1 of scissors and also the pivot axis X so as to form an angle A lying in the range 35° to 60°, and preferably close to 45°. Over at least a fraction of its length, going from its zone connected to the blade 3 towards its free end, this first shank 4 also departs from the blade movement plane P2 by an angle B of at least 35°, and preferably lying in the range 35° to 70°.

This first shank 4 is a shank with a bend that subdivides the first shank into two portions, namely a first portion 41 that extends between the zone where the first shank 4 is connected to the blade 3, and a second portion 42 that extends between the bend and the free end of the first shank.

The first portion 41 of the first shank 4 is of a width of not less than 1.5 cm and it co-operates with the second portion of the first shank to form an angle C lying in the range 80° to 120°, and preferably close to 100°.

The second portion 42 of the first shank 4 is curved, with the concave side of the curve facing towards the movement plane P2 of the blades 3.

Figure 7:
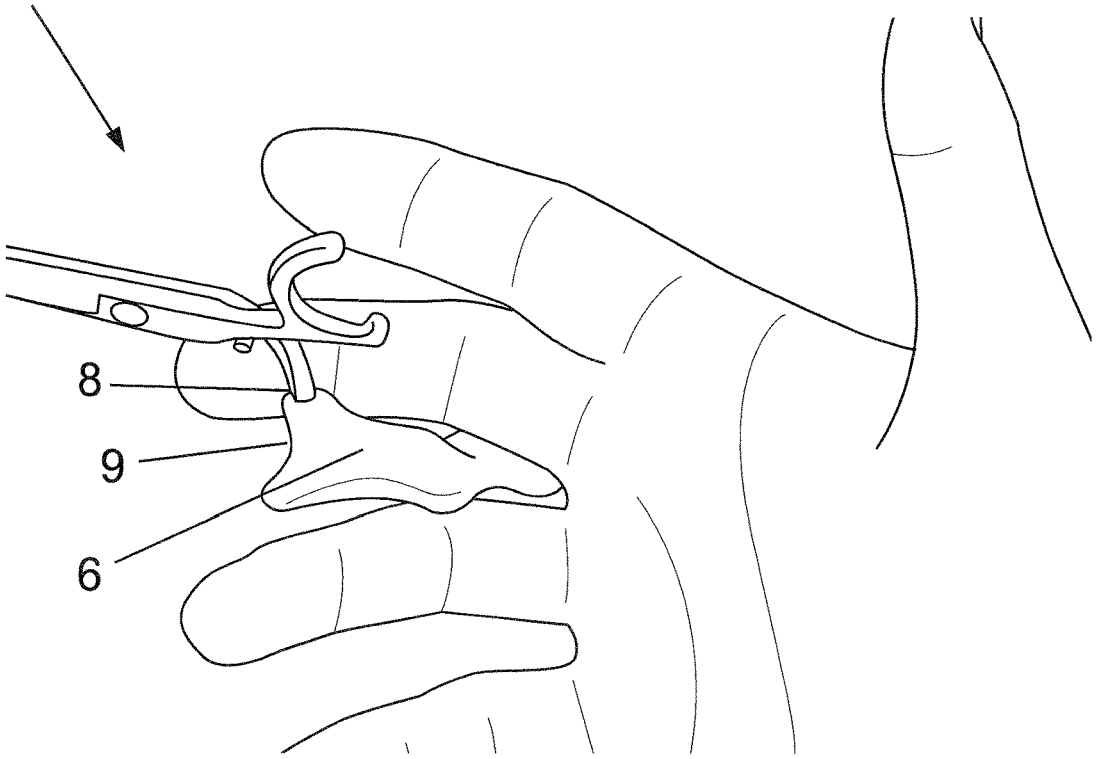
FIGS. 7 and 8 are in the form of two diagrammatic fragmentary views showing the steps of taking hold of the pair of scissors in one hand.

When the pair of scissors is in its utilization configuration, this first shank 4 is covered at least in part by a grip 6. The grip 6 is made of rubber or of an elastomer preferably selected from the group constituted by a silicone rubber, a nitrile rubber, an ethylene-propylene-diene monomer (EPDM), or a polyurethane having hardness lying in the range 60 to 80 on the Shore A scale. The grip 6 is in the form of an elongate body suitable for being inserted transversely between two fingers, specifically in this example the ring finger and the middle finger of a hand, to a position where it bears against the crook where said fingers meet, as shown in FIG. 7.

For this purpose, said grip 6 has two opposite longitudinal faces each forming a face 61 for bearing against the proximal phalange of one of the fingers of the pair of fingers between which the grip 6 is suitable for being inserted. The pair of fingers is formed either by the ring finger and the middle finger, or else by the middle finger and the index finger.

This grip 6 also has a lateral opening 8 formed in one of the bearing faces in the proximity of one of the ends of said body.

Specifically, in the example shown, one of the bearing faces 61 tends to go away from the other bearing face 61 in the vicinity of one end of said body so as to form a chimney at the surface of said bearing face 61 with an open top that, at said opening, defines the lateral opening 8 of the grip 6. The first shank of the pair of scissors is suitable for being inserted into the inside of said chimney.

Figure 4:
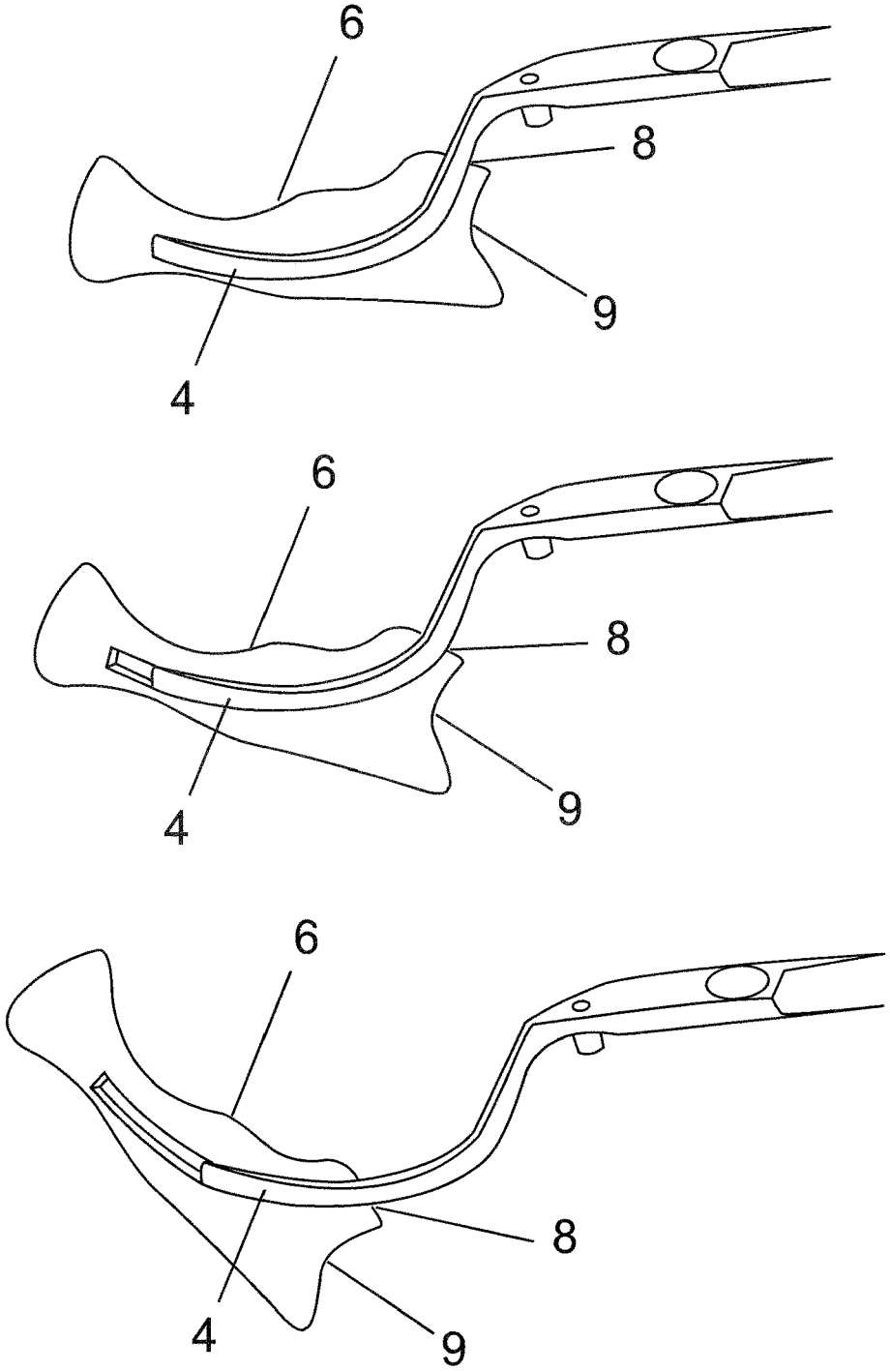
FIG. 4 is in the form of three fragmentary views of the first shank, showing examples of positions that can be taken by the first shank within the sheath formed by the grip.
Figure 5:
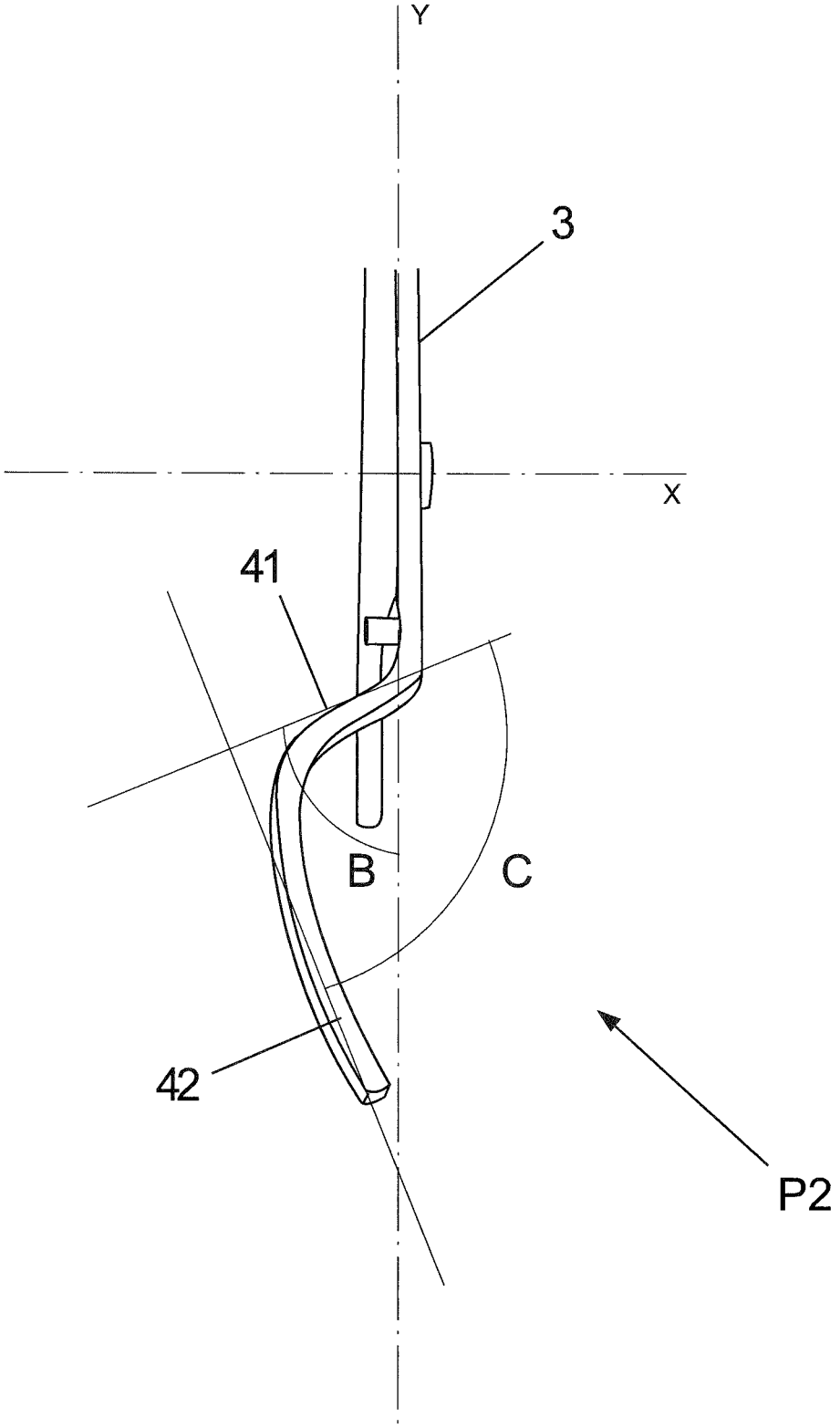
FIG. 5 is a fragmentary side view of a pair of scissors, with the grip omitted.
Figure 6:
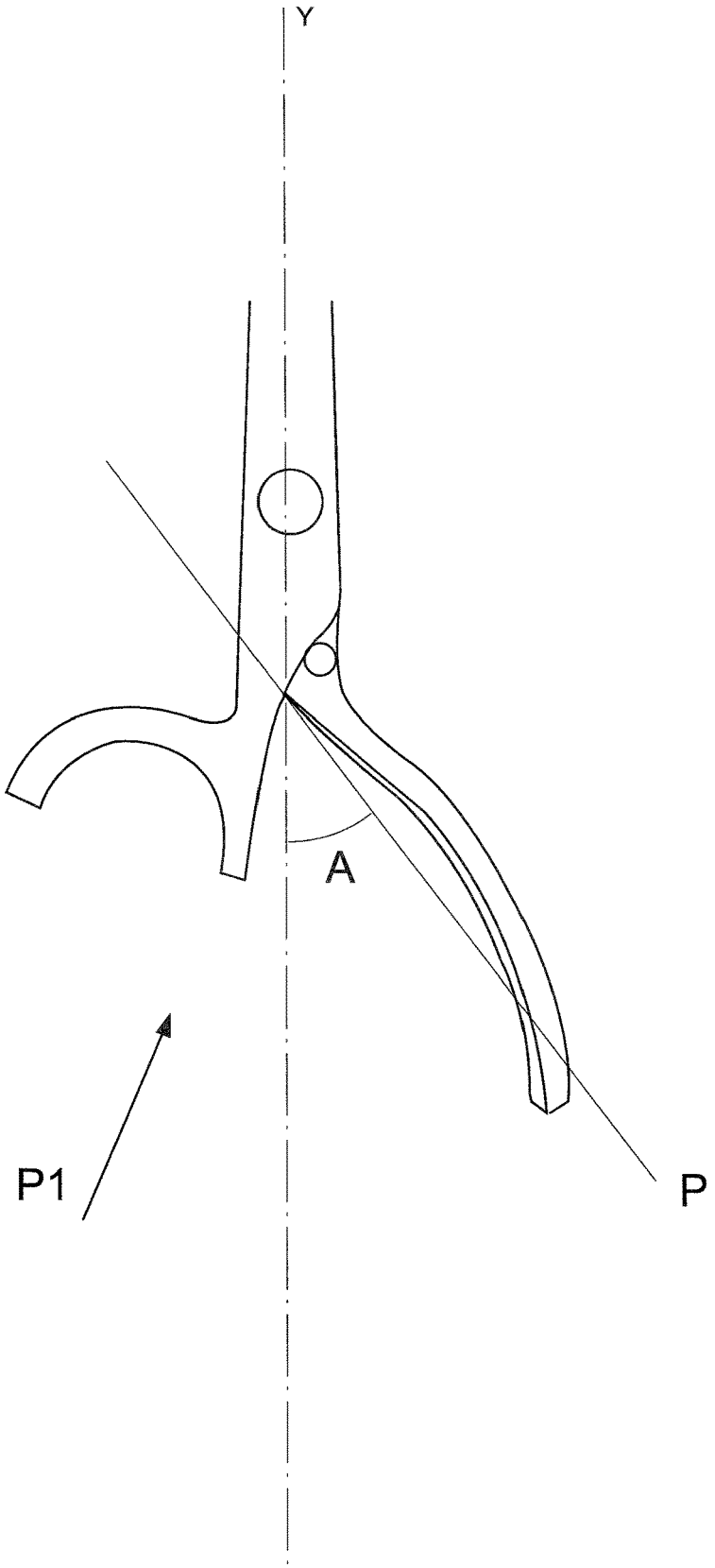
FIG. 6 is a fragmentary view seen from the rear of a pair of scissors, the grip being omitted.

The lateral opening 8 is extended by the chimney flue that then continues inside the grip going towards the end of the body that is remote from its end adjacent to said opening, so as to give said grip the shape of a sheath. This passage formed in this way in the grip is shown in FIG. 4. Inside the grip, this passage is of curved shape, being complementary to the shape of the second portion 42 of the first shank 4. The longitudinal bearing faces 61 meet to form longitudinal edges. The longitudinal edge that is to be inserted in the crook where two fingers meet presents a concave shape over a fraction of its length in order to facilitate such insertion. The chimney flue forms a pivot around which one of the fingers is wound prior to coming to bear via its distal phalange on an end of the elongate body constituting the grip and referred to as the "bearing zone" 9. In this example, the grip is inserted between the middle finger and the ring finger, and the finger that is wound around the pivot is the middle finger.

As shown in FIG. 4, the first shank can be inserted inside the passage in the grip and can be moved in sliding inside it so as to occupy a position that varies as a function of the length and the width of the finger that is to bear against the bearing zone 9, specifically in this example the middle finger of the hand of the operator.

Where necessary, this sliding movement also makes it possible to position the middle finger and the ring finger side by side.

Figure 3:
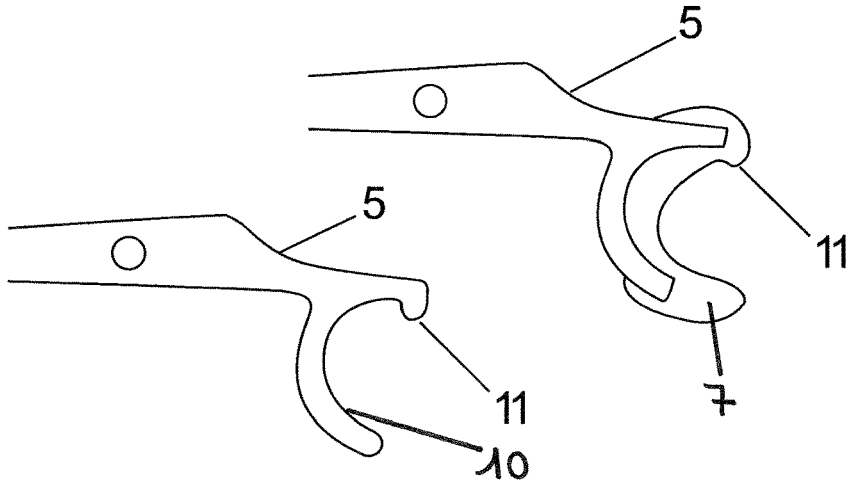
FIG. 3 is in the form of two fragmentary plan views of the second shank, showing two embodiments of the retaining abutment.
Figure 8:
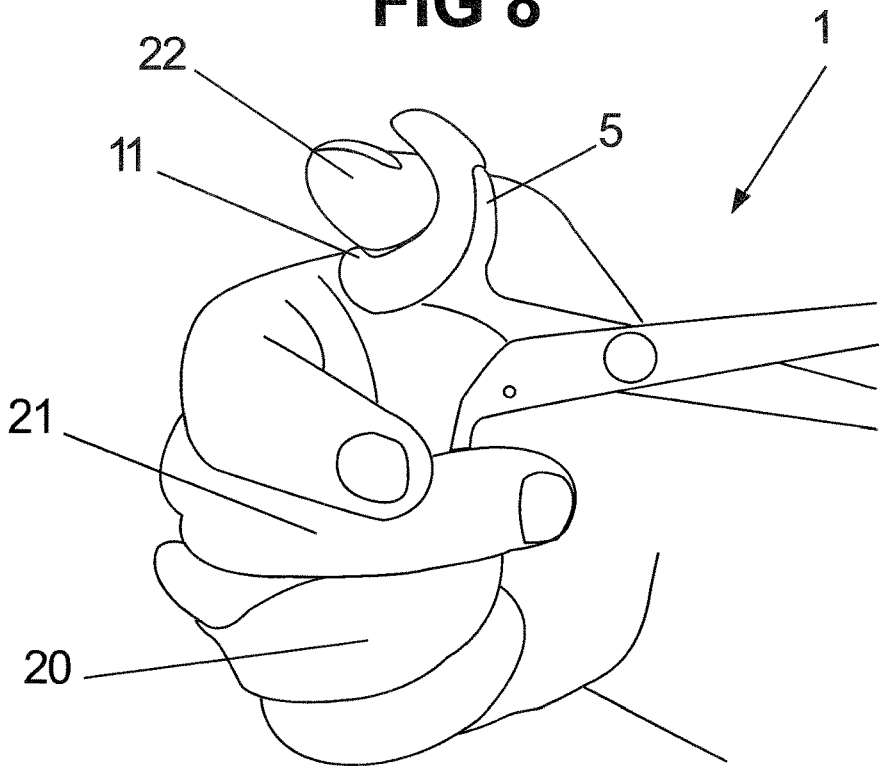

The second shank 5 of the pair 1 of scissors is terminated by a half-ring forming a cradle 10 for receiving the thumb, as shown in FIG. 8. The end of the cradle 10 that is closer to the first shank bends towards the inside of the cradle to form a retaining abutment for retaining the thumb. This retaining abutment 11 may be made in the form of a fitting 7 fitted on said cradle 10, as shown in the top diagram of FIG. 3, or else it may be made integrally with the cradle 10, as shown in the bottom diagram of FIG. 3.

Independently of the embodiment, this retaining abutment 11 serves to prevent the thumb from sliding out of the half-ring, and thus to facilitate transmitting force from the hand to the pair of scissors.

When the abutment is made in the form of a fitting 7, the fitting may be made out of elastomer or of rubber. The fitting 7 in this example is C-shaped, with a free end of the C-shape bending towards the inside of the C-shape, the back of the C-shape being provided with a slot to enable said fitting to be positioned by being slotted onto the cradle 10 of the second shank 5.

Said cradle 10, which is arranged in a plane parallel to the movement plane P2 of the blade 3, defines a portion of a circle of center O, and the straight line passing through the center O of the circle and the point of intersection between the pivot axis X and the longitudinal axis Y of the blade 3 co-operates with the longitudinal axis Y of the pair 1 of scissors to form an angle D of at least 20°.

In order to finish off the assembly, the grip 6 and the first shank 4 include respective marks 12, 13 for identifying how to introduce the first shank 4 into the inside of the grip 6. These marks may be merely punch marks in the grip and in the first shank.

In order to take hold of such a pair of scissors, it is possible to proceed as follows: with a hand resting via its edge on a plane surface, the grip 6 carried by the first shank of the pair of scissors is inserted between the middle finger 21 and the ring finger 20, with the bearing faces of the grip facing the proximal phalanges of those fingers. Thereafter, the thumb 22 is placed in the cradle of the second shank. This completes taking hold of the pair of scissors.

The invention claimed is:

1. A pair of scissors, comprising:

two shears mounted to pivot about an axis, each of said shears comprising a blade extended by shanks, said blades extending in a closed position of the pair of scissors along a longitudinal axis of the pair of scissors, a first shank of the shanks, bends and extends from said longitudinal axis at an acute angle of 35° to 60°, said bend being in a first plane containing said longitudinal axis, the first shank being covered at least in part by a grip, said grip in the form of an elongate body, suitable for being inserted transversely between two fingers of a user's hand to a position in which said elongate body bears against a crook where said user's fingers join together, the grip having a lateral opening and, at the end of the elongate body adjacent to said opening, a bearing zone for a distal phalange of at least one of the fingers between which the grip is suitable for being inserted, a second shank of said shanks, being terminated by a half-ring forming a cradle for receiving a thumb, wherein the first shank is of rectangular or square cross-section and has two portions, a first portion between said pivot axis and a mid-shank curve, and a second portion between said mid-shank curve and a free end, said first shank also initially bending out of a second plane, also including said longitudinal axis but being perpendicular to said first plane, away from said longitudinal axis at angle lying between 35° to 70°, and further having a second bend in said second plane between said first and second portions, said bend between said first and second portions of said first shank forming an angle lying in the range 80° to 120° curving back towards said longitudinal axis, and wherein the grip is elastically deformable having its lateral opening extended into an inside of the grip forming a sheath into which at least the free end and second portion of the first shank can be inserted in a position-adjustable manner by a sliding movement, and wherein an end of the cradle on the second shank, closer to the first shank, has a bend towards the inside of the cradle so as to form an abutment for retaining the thumb.

2. The pair of scissors according to claim 1, wherein the first portion of the first shank presents a length of not less than 1.5 cm.

3. The pair of scissors according to claim 1, wherein the retaining abutment is made in the form of a fitting fitted to said cradle.

4. The pair of scissors according to claim 1, wherein the cradle and the retaining abutment are made as a single piece.

5. The pair of scissors according to claim 1, wherein said cradle, arranged in a plane parallel to the plane in which the blades move, defines a center portion of a circle, and in that the straight line passing through the center portion of the circle and a point of intersection between the pivot and longitudinal axes of the blades co-operate with the longitudinal axis of the pair of scissors to form an angle of not less than 20°.

6. The pair of scissors according to claim 5, wherein the distance between the center portion of the circle defined by the cradle and the point of intersection between the pivot and longitudinal axes of the blades is not less than 3.5 cm.

7. The pair of scissors according to claim 1, wherein the second portion of the first shank is curved with a concave side facing towards the longitudinal plane.

8. The pair of scissors according to claim 1, wherein the grip and the first shank include respective markings for identifying how to insert the first shank into the inside of the grip.

9. The pair of scissors according to claim 1, wherein the grip is made of rubber or of elastomer selected from the group consisting of silicone rubber, a nitrile rubber, an ethylene-propylene-diene monomer (EPDM), or by a polyurethane, having hardness lying in the range 60 to 80 on the Shore A scale.

* * * * *